US011819130B2

(12) United States Patent
Piatt

(10) Patent No.: US 11,819,130 B2
(45) Date of Patent: Nov. 21, 2023

(54) SEATING WITH INTERCHANGEABLE HEXAGON SHAPED CUSHIONS

(71) Applicant: James Piatt, Los Angeles, CA (US)

(72) Inventor: James Piatt, Los Angeles, CA (US)

( * ) Notice: Subject to any disclaimer, the term of this patent is extended or adjusted under 35 U.S.C. 154(b) by 0 days.

(21) Appl. No.: 17/694,714

(22) Filed: Mar. 15, 2022

(65) Prior Publication Data

US 2023/0292928 A1 Sep. 21, 2023

(51) Int. Cl.

| | |
|---|---|
| ***A47C 4/02*** | (2006.01) |
| ***A47C 7/18*** | (2006.01) |
| ***A47C 7/46*** | (2006.01) |
| ***A47C 13/00*** | (2006.01) |

(52) U.S. Cl.

CPC ..... *A47C 13/005* (2013.01); *A47C 4/02* (2013.01); *A47C 7/18* (2013.01); *A47C 7/46* (2013.01)

(58) Field of Classification Search

CPC .... A47C 4/02; A47C 7/18; A47C 7/46; A47C 13/005

USPC ..... 297/284.3, 440.1, 440.14

See application file for complete search history.

(56) References Cited

U.S. PATENT DOCUMENTS

| | | | | |
|---|---|---|---|---|
| 3,170,730 A * | 2/1965 | Beckman | A47C 3/12 297/284.3 |
| 6,296,314 B1 * | 10/2001 | Klein | A47B 85/04 297/440.14 |
| 7,931,340 B1 * | 4/2011 | Reddick | A47C 13/005 297/440.14 X |
| 2013/0129405 A1 * | 5/2013 | Everett | A47B 13/088 403/66 |
| 2016/0135601 A1 * | 5/2016 | Curren | A47C 7/14 297/452.13 |
| 2018/0235374 A1 * | 8/2018 | Kroll | A47C 7/425 |

FOREIGN PATENT DOCUMENTS

| | | | | |
|---|---|---|---|---|
| KR | 2019043972 A * | 4/2019 | A47C 21/048 |

* cited by examiner

*Primary Examiner* — Rodney B White

(57) ABSTRACT

A novel form of furniture where various types of seating arrangements which can be provided with interchangeable hexagon shaped cushions to achieve swivel chair, sofa and stool configuration. The assembly allows easy to assemble and disassemble structure where multiple configurations can be achieved with slide adjustments. The assembly allows enhanced air circulation, easy removal and placement of cushions, easy storage, interchangeable cushions and allows user to replace or service individual cushions without the need to replace the entire furniture piece. The cushions are also interchangeable for aesthetic choices where user can create different color combinations based on their aesthetic preference. Cushion units can be replaced to change its visual appearance without the need to replace the entire chair.

2 Claims, 6 Drawing Sheets

SEATING WITH INTERCHANGEABLE HEXAGON SHAPED CUSHIONS

BACKGROUND

Field of the Invention

The present invention relates generally to a seating arrangement with hexagonal cushions and components of varying designs that can be interchanged by the user. More particularly, the present invention relates to a combination of hexagonal shaped cushions and support structure which can be used to form decorative adjustable sofa and swivel chair with backrests, headrests, armrests, and footrests which easily and securely attach to a chair frame by the consumer. The similar assembly can also be used to form a swivel chair and stool configuration.

Description of the Related Art

Regardless of home, apartment, office or the like, people tend to buy furniture which matches the requirements and decor of the room where the piece of furniture will be placed. People tend to spend hundreds to thousands of dollars in order to purchase multiple type of furniture to suit their requirements. However, as time goes by, many people like to change the appearance or the functionality of their piece of furniture to fulfil their changing or additional requirements. However, this requirement can be extremely expensive.

Presently there are multiple types of furniture available which are convertible and fulfil user's requirements. By looking at prior art multiple types of patents have been seen in similar regards. For instance, U.S. Pat. No. 5,779,317A implies a mix and match chair having a plurality of legs and removable chair components such as seats, backrests, footrests, and armrests. The mix and match chair comprises a chair frame having a backrest portion and a seat portion. Attached to the backrest and seat portion is a backrest pan and a seat pan, respectively. The pans have holes and at least one raised locator area. The seat and backrest have arcuate shaped apertures and a cutout. The cutouts mate with the raised locator area of the pans. Thus, the locator areas provide a mechanism for precise placement of the chair component and for the firm attachment of the chair component to the chair frame. Extending through the arcuate shaped apertures and the holes are fasteners. Other chair components are provided with the same mechanism for attaching to the chair frame.

U.S. Pat. No. 3,655,239Aa implies a backrest chair for use in providing seating arrangements in rooms, particularly conference rooms, cinemas, theaters, concert halls and similar rooms and which chair includes a support base adapted to be secured to the floor of such a room, such support base including a pedestal portion and two side portions, and a backrest and a folding seat of practically identical construction so secured to said side portions of said support base as to be adjustable into different positions of use relative to said support base.

WO patent 2,006,020876A2 provides a furniture construction (9), and an associated method of manufacture, that can be converted from a bed to a table (30) and vice versa. According to one embodiment, the furniture construction (9) includes a support structure (10), a bed frame (20) movably connected to the support structure (10) so that the bed frame (20) can be rotated between an inoperative first position and an operative second position, and a table (30) movably connected to the support structure (10) so that the table (30) can be adjusted between an operative first position and an inoperative second position. The bed frame (20) and the table (30) are structured such that when the bed frame (20) is in the operative second position the table (30) is in the inoperative second position, and when the table (30) is in the operative first position the bed frame (20) is in the inoperative second position.

US patent 2,015,0026881A1 implies a bed to a sofa conversion frame, without a seating area, a space reserved for the traditional bed, which is a conventional manufactured mattress, or ii) a conventional manufactured mattress and a box spring, or iii) a conventional manufactured mattress and a two-rail frame, optionally with a box spring. The bed to a sofa conversion frame includes a backrest, a footer (optional) and a pair of armrests configured to be connected as a solid state and or assembled together to form a sofa frame around a traditional bed, wherein the backrest comprises a horizontally-extending backrest ridge configured to hold and secure, directly or indirectly, a conventional manufactured mattress and when used as an option the footer comprises a horizontally-extending backrest ridge configured to hold and secure, directly or indirectly, a mattress. The pair of armrests forms a base for mounting the backrest and the footer via corresponding mounting hardware and mounting slots.

U.S. Pat. No. 6,899,040B2A implies a piece of furniture having interchangeable components is will have a plurality of interchangeable leg members. Cross-bar members are removably coupled to the plurality of leg members. The cross-bar members are adjustable in length. Cross-bar covers are removably coupled to the cross-bar members. A table top is removably coupled to the cross-bar covers.

There are multiple solutions that have been presented in prior art regarding bringing advancements in various types of future with dual functionality. However, these solutions are limited and restricted to their conventional systems. Moreover, by looking at prior art it is evident that a lot of labor and inconvenience would be obviated if some satisfactory means could not be employed for converting the furniture from one shape to another. In general, most pieces of furniture are individually made and constructed together piece by piece permanently. To change the look or appearance of the furniture would require one to take apart and reconstruct the piece of furniture. This would be very time consuming and expensive. Unfortunately, most people do not have the time, money, or skill to fulfil the changing needs too often.

However, the current invention is focused on presenting an ergonomic furniture piece with multiple seating types including a swivel chair, a sofa and a stool of which each seating surface is comprised of a plurality of hexagon shaped cushion units. The assembly is easy and quick to assemble and disassemble, sturdy in its outlook and functionality, securely holds all parts in place, while also being economical to manufacture, reliable, and able to satisfy the performance expectations of the user.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The primary desirable object of the present invention is to provide a novel and improved form of seating with interchangeable hexagon shaped cushions.

The primary objective of this invention is to provide an assembly where unit's hexagon shape makes it possible to assemble the cushions closely together at different angles forming surfaces that comfortably support the user's body in an upright or relined position It is another objective of the invention to provide novel form of furniture arrangement which has multiple seating types including a swivel chair, a sofa and a stool of which each seating surface is comprised of a plurality of hexagon shaped cushion units.

It is further the objective of the invention to provide a seating where the user can replace or service individual cushions without the need to replace the entire furniture piece.

It is also the objective of invention to provide space between the cushion offer air circulation for improved comfort.

It is further the objective of the invention to provide assembly where different cushion units receive different amounts of wear over time they can be rotated and installed on different positions on the frame.

It is also the objective of the invention to provide seat cushion which is interchangeable with the back cushion and can be easily removed for storing.

It is also the objective of invention to provide assembly where when used in a group that includes more than one seating product the hexagonal cushion units can be interchangeable across each other. A stool cushion is interchangeable with a sofa cushion and so on.

It is also the objective of invention to provide cushions which are also interchangeable for aesthetic choices. The user can create different color combinations based on their aesthetic preference. Cushion units can be replaced to change its visual appearance without the need to replace the entire chair.

A still further object is to provide a bottle holder that is economical in cost to manufacture.

It is a further object of the present invention to provide a new and improved form of furniture which is of a durable and reliable construction.

Still yet another object of the present invention is to provide a new and improved seating with interchangeable hexagon shaped cushions which provides in the apparatuses and methods of the prior art some of the advantages thereof, while simultaneously overcoming some of the disadvantages normally associated therewith.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
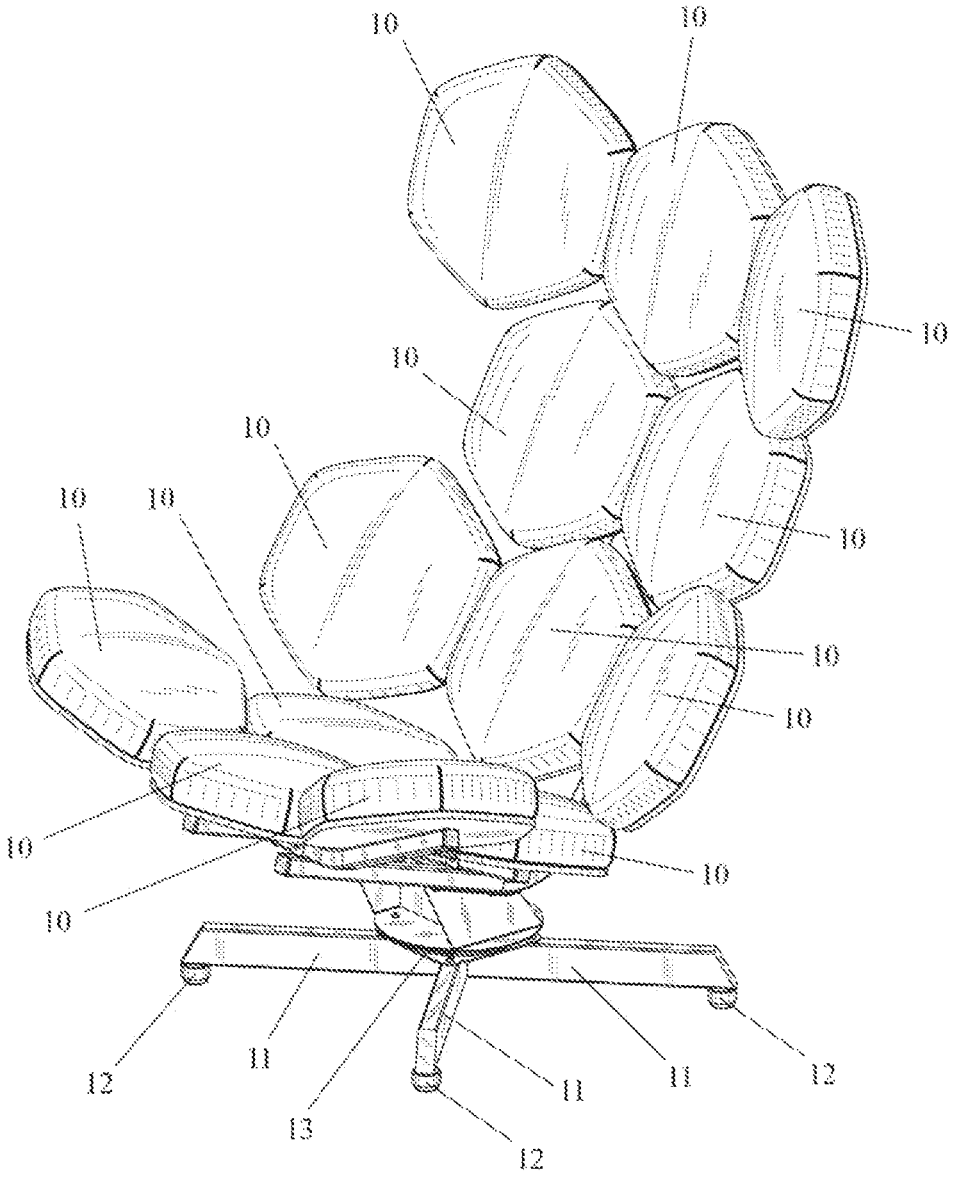
FIG. 1 is an isometric view of my lounge chair with interchangeable hexagon shaped cushions as per preferred embodiments of the invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The current invention proposes to provide a furniture arrangement with interchangeable hexagonal shaped cushions to support various needs of users.

By looking at FIG. 1 the complete architecture of proposed assembly can be seen. The interchangeable hexagon shaped cushions (10) can be placed in multiple arrangements. The FIG. 1 shows a swivel chair arrangement, where hexagon shaped cushions (10), are placed on a seating frame which comprises of metal tube (11), chair foot (12), swivel base (13) and bolts (14). The locking mechanism is used to hold and lock the cross-member at a desired length.

Figure 2:
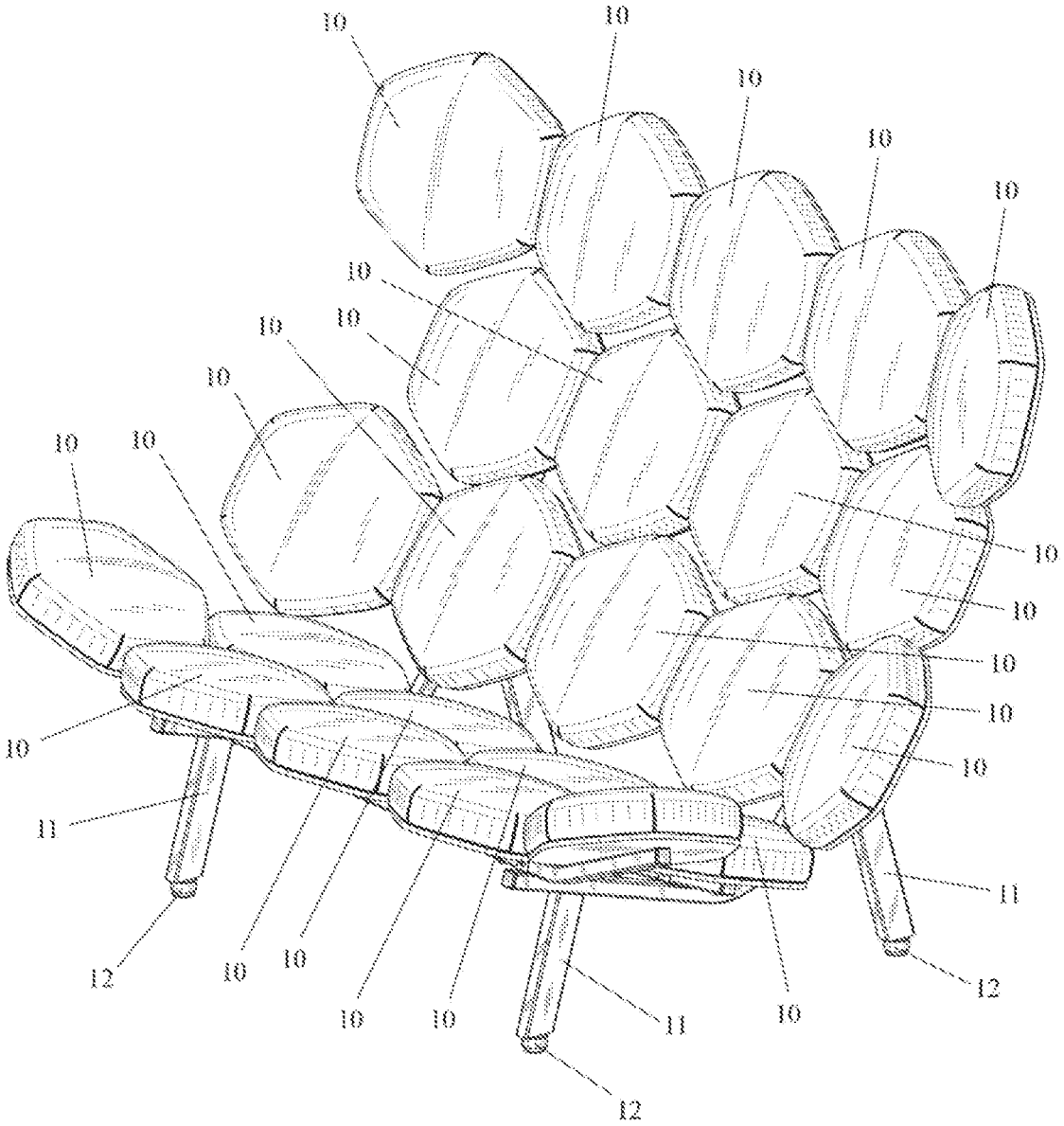
FIG. 2 is an isometric view of my sofa with interchangeable hexagon shaped cushions as per preferred embodiments of the invention.

The FIG. 2 shows the detailed view of sofa seating with interchangeable hexagonal shaped cushion. The arrangement consist of hexagon shaped cushions (10), are placed on a seating framework which comprises of metal tube (11), chair foot (12), swivel base (13) and bolts (14).

Figure 3:
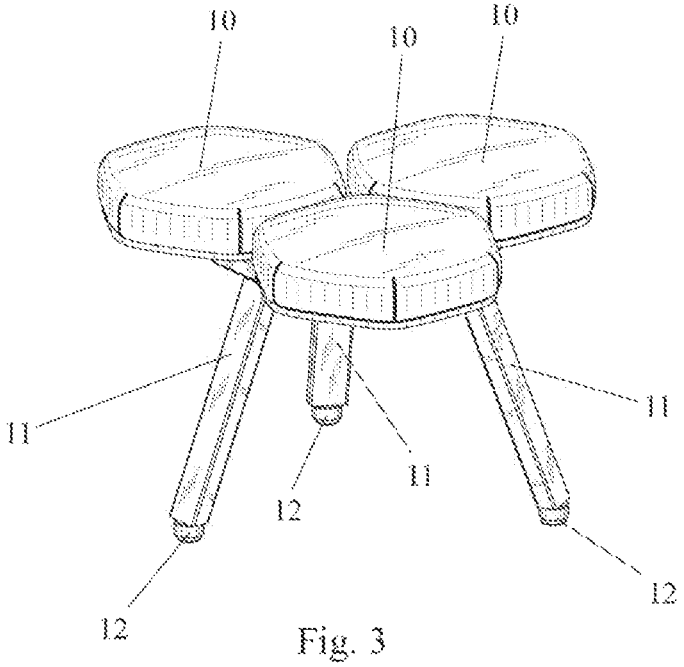
FIG. 3 is an isometric view of my stool with interchangeable hexagon shaped cushions as per preferred embodiments of the invention.

The FIG. 3 shows the detailed view where the hexagon shaped cushions (10) are arranged to form a stool shaped furniture. The cushions (10) are placed on a seating framework which comprises of metal tube (11), chair foot (12), swivel base (13) and bolts (14).

Figure 4:
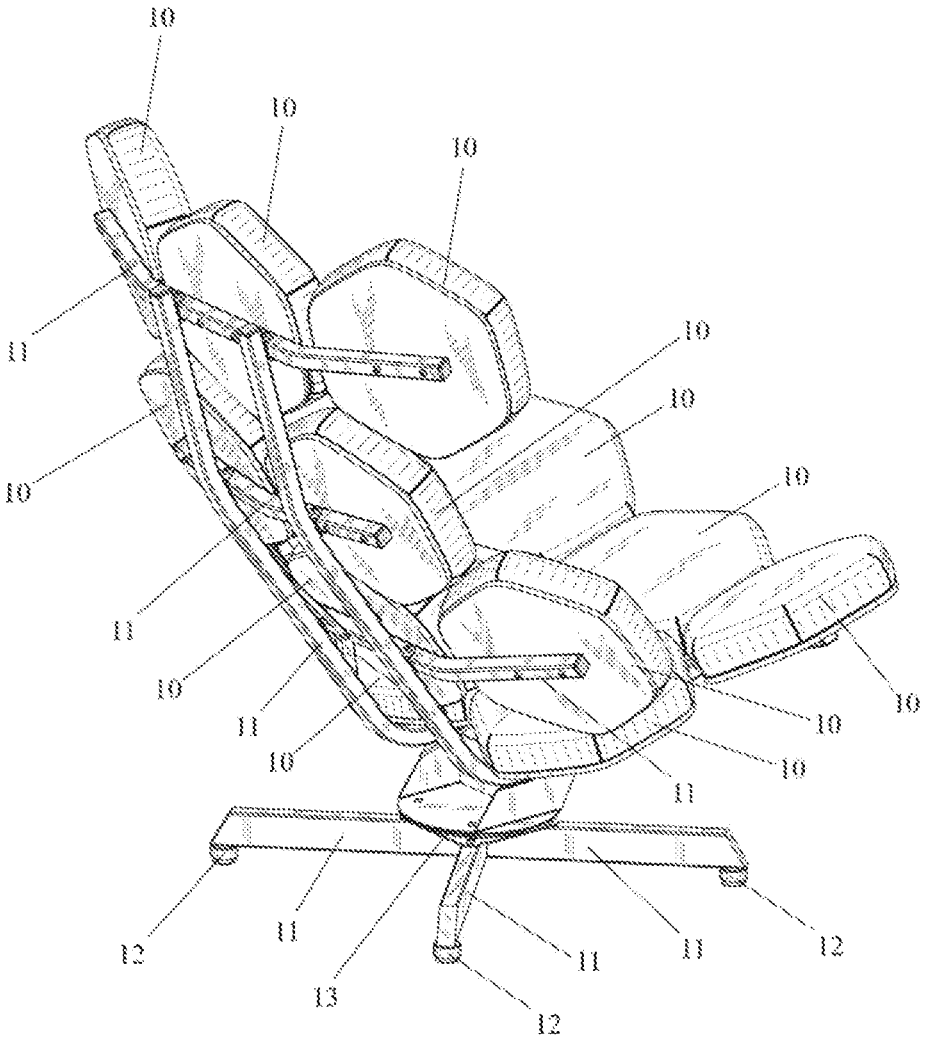
FIG. 4 is an isometric view of my lounge chair with interchangeable hexagon shaped cushions from behind as per preferred embodiments of the invention.

The FIG. 4 shows an isometric view of lounge chair with interchangeable hexagon shaped cushions from behind where in addition to hexagon shaped cushions (10), metal tube (11), chair foot (12), swivel base (13) and bolts (14) can be clearly seen.

Multiple seating arrangements as shown including a swivel chair FIG. 1, a sofa FIG. 2 and a stool FIG. 3 of which each seating surface is comprised of a plurality of hexagon shaped cushion units. The seating with interchangeable hexagon shaped cushions includes a seating frame and a plurality of cushions. Seating frames are either a chair, a sofa or a stool. The chair frame as per its further embodiments has legs, a seat and back portion supported by the legs. The chair may also include a swivel structure to provide rotation.

Figure 5:
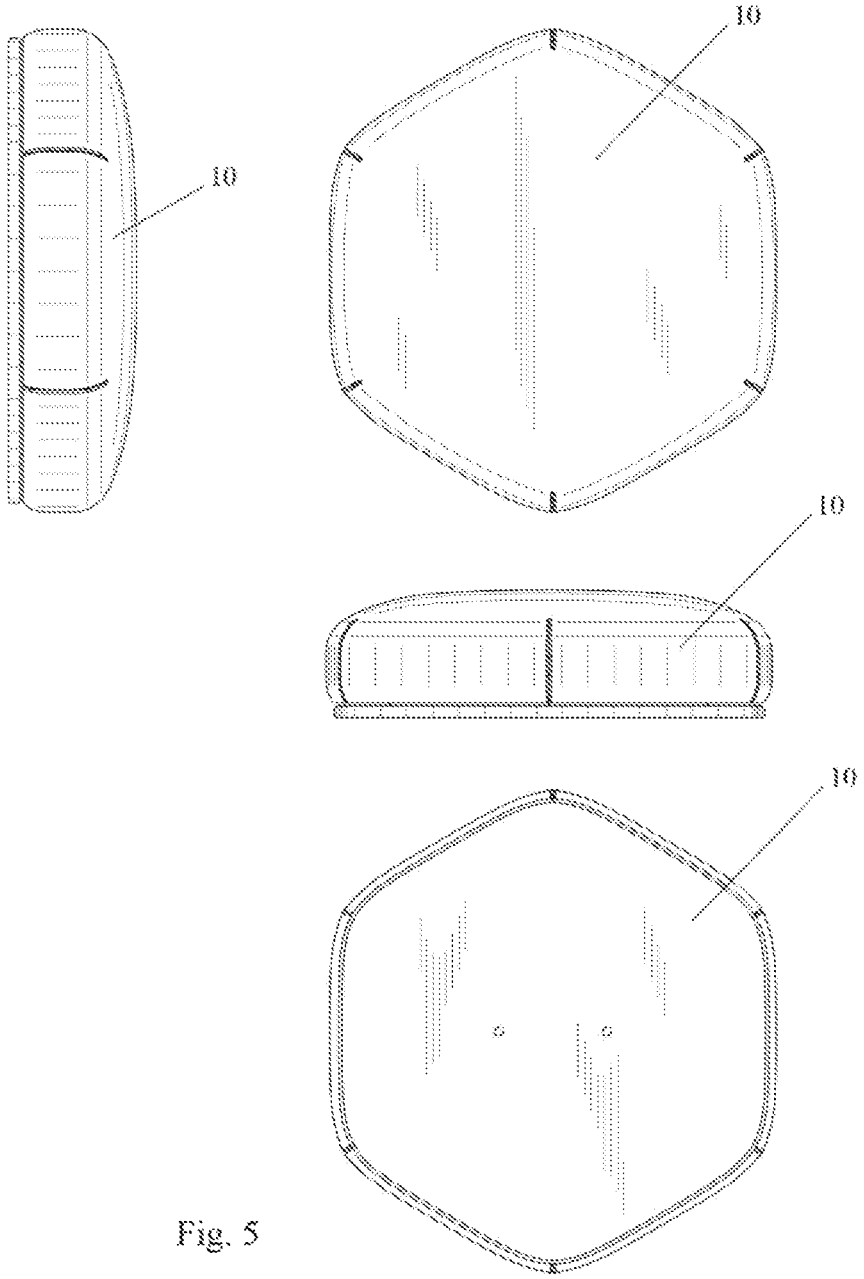
FIG. 5 are orthographic views of the interchangeable hexagon shaped cushion as per preferred embodiments of the invention.

An all-inclusive, standard unit hexagon shaped cushion FIG. 5 where the same cushion can be assembled together on frameworks to form different seating configurations. The unit's hexagon shape makes it possible to assemble the cushions closely together at different angles forming surfaces that comfortably support the user's body in an upright or relined position. The hexagon shape of the cushion is ideal for linking multiple cushions together to create a seating surface.

Figure 6:
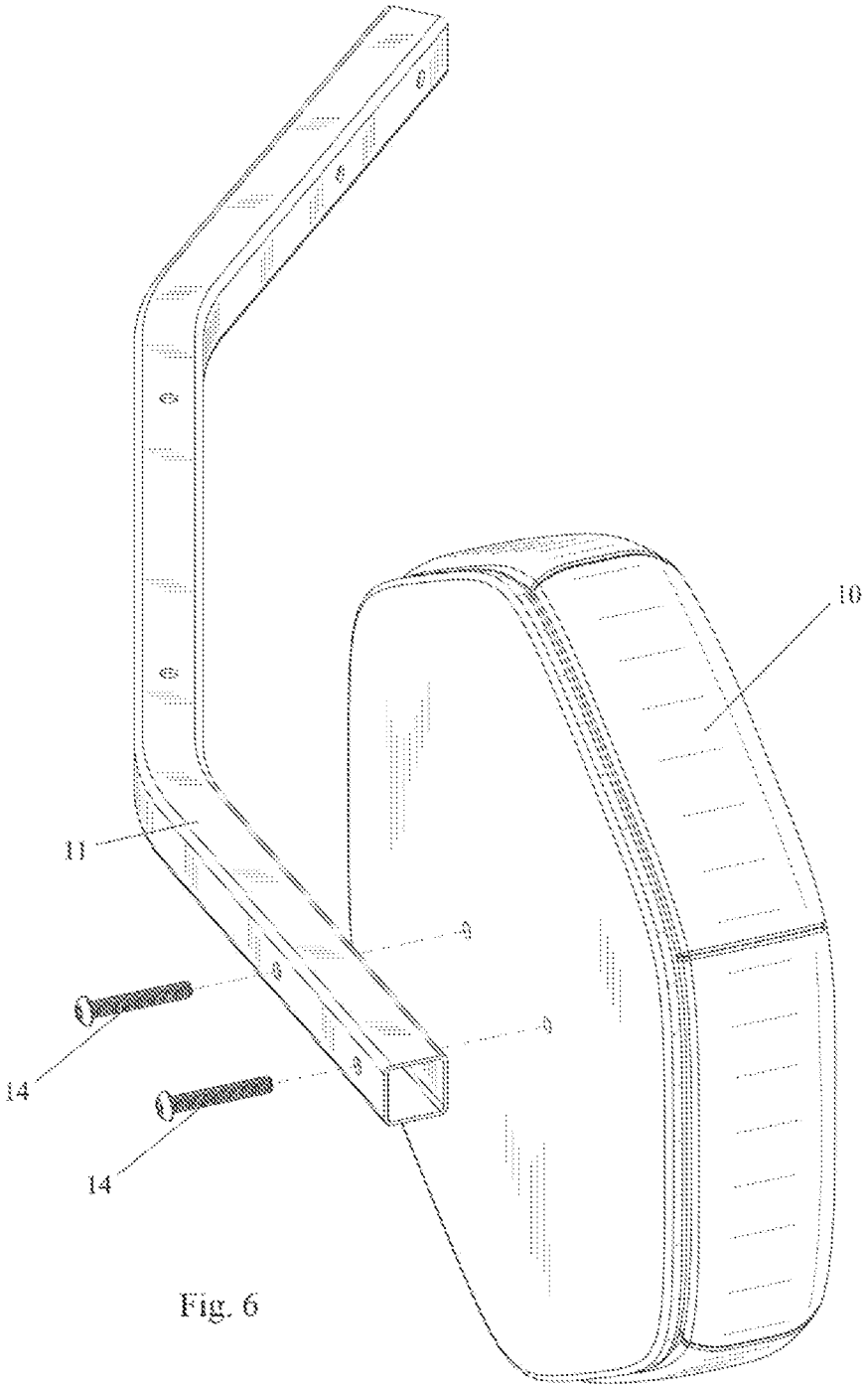
FIG. 6 is an isometric view of how the interchangeable hexagon shaped cushion is attached to the frame as per preferred embodiments of the invention.

The cushions may be attached or removed with bolts as shown in FIG. 6. The unit is used as both a seat and back cushion and both cushions are interchangeable. The seat cushion is supported by the seat portion and is designed to hold the weight of a user sitting. The back cushions are supported by a framework.

The metal tube (11) may be made in a plurality of shapes and materials. For example, the metal tube may be flat and rectangular as shown in FIGS. 1-4. Alternatively, the metal tube may be more rounded like to support the upright position of assembly. The metal tube (11) may be made out of a solid hard material like metal and steel. Alternatively, the interchangeable hexagon shaped cushion (10) has exterior made of leather with memory foam and yoga mat foam. Thus, one would be able to comfortably rest one's body, feet, arms, or the like on the main assembly. It should be noted that the above are given as examples and should not be seen as to limit the scope of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A seating arrangement with interchangeable hexagon shaped cushions comprising:

a swivel chair having a first seating surface;

a sofa having a second seating surface; and, a stool having a third seating surface;

wherein the first seating surface, the second seating surface, and the third seating surface each is comprised of a plurality of hexagon shaped cushions, wherein the hexagon shaped cushions can be attached or removed easily with bolts;

wherein a seating structure comprises a seating frame;

wherein the seating structure comprises legs, a seat and a back portion supported by the legs; and, wherein seating structure includes a swivel structure to provide rotation.

2. An interchangeable hexagon shaped cushion to provide multiple seating arrangements where:

the interchangeable hexagon shaped cushion comprises memory foam padding;

the interchangeable hexagon shaped cushion comprises yoga mat foam padding;

the interchangeable hexagon shaped cushion comprises an exterior developed from high grade leather;

the interchangeable hexagon shaped cushion comprises multiple colors;

interchangeable hexagon shaped cushions can be joined closely together at different angles forming surfaces to support the user's body in an upright or reclined position comfortably;

the interchangeable hexagon shaped cushions can be attached or removed easily with bolts; and, interchangeable hexagon shaped cushions arrangement provides increased air circulation for improved comfort.

* * * * *